US008556343B2

(12) United States Patent
Rubinshteyn

(10) Patent No.: US 8,556,343 B2
(45) Date of Patent: Oct. 15, 2013

(54) VERSATILE SEAT LINER

(76) Inventor: Stella Rubinshteyn, Morganville, NJ (US)

( * ) Notice: Subject to any disclaimer, the term of this patent is extended or adjusted under 35 U.S.C. 154(b) by 82 days.

(21) Appl. No.: 13/177,969

(22) Filed: Jul. 7, 2011

(65) Prior Publication Data

US 2013/0009434 A1 Jan. 10, 2013

(51) Int. Cl.
*A47C 31/00* (2006.01)

(52) U.S. Cl.
USPC ..... 297/219.12; 297/228.12; 297/228.13; 297/229

(58) Field of Classification Search
USPC ..... 297/219.12, 220, 225, 228.12, 228.13, 297/229
See application file for complete search history.

(56) References Cited

U.S. PATENT DOCUMENTS

| | | | | |
|---|---|---|---|---|
| 4,383,713 | A * | 5/1983 | Roston | 297/228.12 |
| 4,621,004 | A | 11/1986 | Madsen | |
| 5,916,089 | A * | 6/1999 | Ive | 5/655 |
| 6,224,152 | B1 | 5/2001 | Hughes et al. | |
| 6,428,098 | B1 | 8/2002 | Allbaugh | |
| 6,951,367 | B1 * | 10/2005 | Dinnan | 297/228.12 |
| 7,065,814 | B2 | 6/2006 | Rutkowski | |
| 7,097,244 | B2 * | 8/2006 | Holmgren et al. | 297/219.12 |
| 7,222,917 | B2 * | 5/2007 | Ward | 297/223 |
| 7,350,252 | B2 | 4/2008 | Telegadis et al. | |
| 7,694,371 | B2 | 4/2010 | Telegadis et al. | |
| 2005/0005362 | A1 | 1/2005 | Verbovszky | |
| 2005/0166326 | A1 | 8/2005 | Chaffee | |
| 2005/0210592 | A1 | 9/2005 | Littlehorn et al. | |
| 2006/0064819 | A1 | 3/2006 | Mollett | |
| 2006/0096031 | A1 | 5/2006 | Foster | |
| 2006/0282953 | A1 | 12/2006 | Telegadis et al. | |
| 2007/0032561 | A1 | 2/2007 | Lin | |
| 2007/0052277 | A1 * | 3/2007 | Smulders et al. | 297/484 |
| 2007/0251013 | A1 | 11/2007 | Borror et al. | |
| 2007/0262624 | A1 * | 11/2007 | Snedeker | 297/219.1 |
| 2008/0034505 | A1 | 2/2008 | Thomas | |
| 2008/0116730 | A1 | 5/2008 | Connolly et al. | |
| 2008/0179926 | A1 * | 7/2008 | Kushner | 297/220 |
| 2009/0038078 | A1 | 2/2009 | House | |
| 2009/0044333 | A1 | 2/2009 | Colleran et al. | |
| 2009/0056017 | A1 | 3/2009 | Jones | |
| 2009/0235461 | A1 | 9/2009 | Straub | |
| 2009/0249526 | A1 | 10/2009 | Carangelo | |
| 2010/0058538 | A1 | 3/2010 | Rieber | |
| 2010/0066138 | A1 | 3/2010 | Rumack | |

OTHER PUBLICATIONS

Tivoli Couture Inc., *Tivoli Couture Wins iParenting Award for the Outstanding Products of 2009 in Baby Gear*, Aug. 10, 2009, PR Log—Global Press Release Distribution (Internet blog).

* cited by examiner

*Primary Examiner* — David Dunn
*Assistant Examiner* — Timothy J Brindley
(74) *Attorney, Agent, or Firm* — Oleg A. Mestechkin; Antonio Papageorgiou

(57) ABSTRACT

A seat liner is provided that includes a cushion within the seat liner, the cushion includes a body of memory foam and a soft, flexible, and washable material located upon said body of memory foam. In a preferred embodiment, the seat liner may be folded into a folded position, or it may be rolled into a rolled position in order to ensure maximum portability. Further, said seat liner may also includes one or more means for attaching various accessories, such as toys, bottles, blankets, and pacifiers.

11 Claims, 3 Drawing Sheets

VERSATILE SEAT LINER

FIELD OF INVENTION

This application relates generally to a versatile, reversible, washable and decorative seat liner designed to be used in a wide variety of modifications of strollers, car seats, high chairs, and to be used as a play mat or diaper changing pad for infants.

BACKGROUND

A number of seat liners for strollers, car seats, stroller bassinets, and high chairs have been known in the art for decades. However, there are a number of known unresolved problems with vinyl and synthetic canvas (harsh, polyester, nylon or neoprene) materials from which the stroller upholstery is typically made. Vinyl is hot and sticky in the summer and cold and stiff in winter. Vinyl, canvas and nylon may be rough on delicate skin and do not offer an acceptable level of comfort for children. Also, such materials are difficult to keep clean as they are typically impossible to remove as they are usually permanently attached to the stroller, car, seat, high chair, etc. Moreover, currently used inserts in strollers do not absorb shock or reduce the effect of traveling over rough ground. Therefore, there is a need for a comfortable and versatile seat liner for strollers, stroller bassinets, car seats and high chairs which would address all aforementioned issues and provide its users with benefits of esthetic appeal, help to keep strollers clean and looking new, provide adequate cushioning to absorb shock, reduce musculoskeletal stress and support proper anatomical development in children.

SUMMARY

In the first few years of their lives, children spend a substantial amount of time in their strollers, stroller bassinets, car seats, and cribs which do not provide proper support and comfort. Newborns and infants in particular spend most of their time lying on their back which frequently contributes to a number of negative physiological consequences such as Plagiocephaly, also known as a flat head syndrome.

Problems associated with existing seat liners are addressed in various embodiments of the present invention which is an improved versatile seat liner. Particularly, the present invention relates to a multi-purpose portable seat liner apparatus comprising, the liner, detachable head rest, and detachable blanket, wherein the main panel of the seat liner comprises memory foam insert. Other aspects of the invention are met through the use of soft cloth covers. Although the present invention is designed to be used in a wide variety of modifications of strollers, car seats, high chairs, and to be used as play mats or diaper changing pads for infants, the preferred embodiment is the seat liner for a stroller is described herein.

In general, the present invention is a seat liner that comprises a cushion within said seat liner, said cushion comprising a body of memory foam and a soft, flexible, and washable material located upon said body of memory foam. Properly designed seat liners comprising memory foam help to alleviate most of the problems because such improved liners respond to individual body heat, soften to mold around the child's body, and relieve various pressure points. The disclosed embodiment of this invention provides a comfortable, portable, reversible, and versatile seat liner which may be converted into a play mat or a diaper changing pad—indispensable features for busy parents on the go.

In a preferred embodiment, the seat liner may be folded into a folded position, or it may be rolled into a rolled position in order to ensure maximum portability. Both rolled and folded positions of the seat liner may be secured by various means known in the art. Further, said seat liner also comprises one or more means for attaching various accessories, such as toys, bottles, blankets, and pacifiers. One skilled in the art should appreciate that means for attaching accessories may comprise loops, clips, buttons, snaps, magnets, and the like.

In another preferred embodiment, the seat liner further comprises a raised portion or second body of memory foam, to provide additional comfort in the child's lower back area.

In yet another preferred embodiment, the seat liner may also comprise a detachable heavy blanket to cover a child in the cold weather. Also, a lighter fabric (e.g., gauze, muslin, cotton, etc.) blanket may be provided to be used in warm weather. An SPF fabric may also be provided to protect a child from damaging direct sun rays.

While the intended purpose of the seat liner, as described in the present application, is to ensure child's comfort and safety, the seat liner described in the present application protects and extends the use of strollers by preserving original stroller upholstery from spills and other children related mishaps.

Yet another purpose of the invention is to decorate and/or change the look of the stroller to ensure an esthetic look of the stroller and the seat liner itself. The present invention provides parents with alternatives to upgrade or change the look of an older, hand me down or gender neutral stroller. Fashion forward moms can match their own style by selecting a stylish fabric pattern.

Still yet another intended purpose of the present invention is to have two reversible, different and distinct looks preferably having one side made of soft natural fiber such as Cotton, Bamboo or Organic material with solid, printed or embellished designs. Small children typically have delicate and sensitive skin and many of the currently existing products on the market are made of harsh synthetic fibers like polyester, nylon, mesh, etc., which may cause irritation when they come in contact with children's exposed skin especially in warmer climate. Therefore it is best to have a product constructed with at least one side having a lighter, softer natural fiber touching babies' delicate skin to prevent excessive perspiration and possible irritation.

The second, reverse layer of seat liner can be made with a contrasting color preferably with a soft plush material often referred to as minky or fleece that can provide extra comfort and warmth to the child seated in the stroller in the colder season. By having two separate reversible panels a parent or caregiver can alter the look and decide which side to use and when based on the reasons and explanations given. The material of said cover can also be made of nylon, leather, denim, terry cloth, fur, faux fur or any other suitable material for sewing for added style, versatility and comfort.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method, system, and apparatus of the invention. Together with the description, the drawings serve to explain the principles of the invention.

The below description is focused on a representative sample of all possible embodiments, a sample that teaches the principles of the invention and conveys the best mode contemplated for carrying it out. Throughout this application and its associated file history, when the term "invention" is used, it refers to the entire collection of ideas and principles described; in contrast, the formal definition of the exclusive protected property right is set forth in the claims, which exclusively control. The description does not attempt to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. In many cases, one feature or group of features may be used separately from the entire apparatus or methods described. Many of those undescribed variations, modifications and variations are within the literal scope of the following claims, and others are equivalent.

Additional aspects of the present invention will be apparent in view of the description which follows.

DETAILED DESCRIPTION

Figure 2:
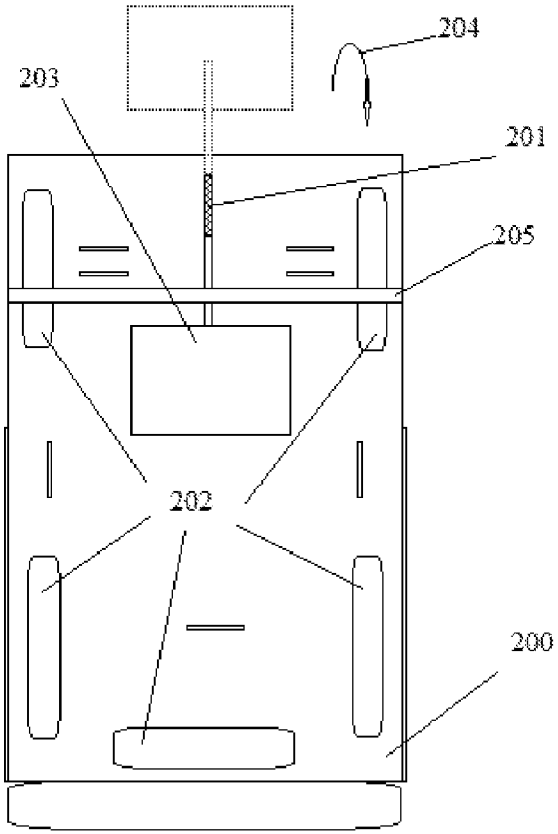
FIG. 2 is a top view of the rear surface of the seat liner situated of a flat surface.

While the present invention may be presented in various embodiments, there is shown in the drawings and will hereinafter be described a presently preferred embodiment with the understanding that the present disclosure is to be considered as an exemplification of the invention, and is not intended to limit the invention to the specific embodiment illustrates.

Figure 1:
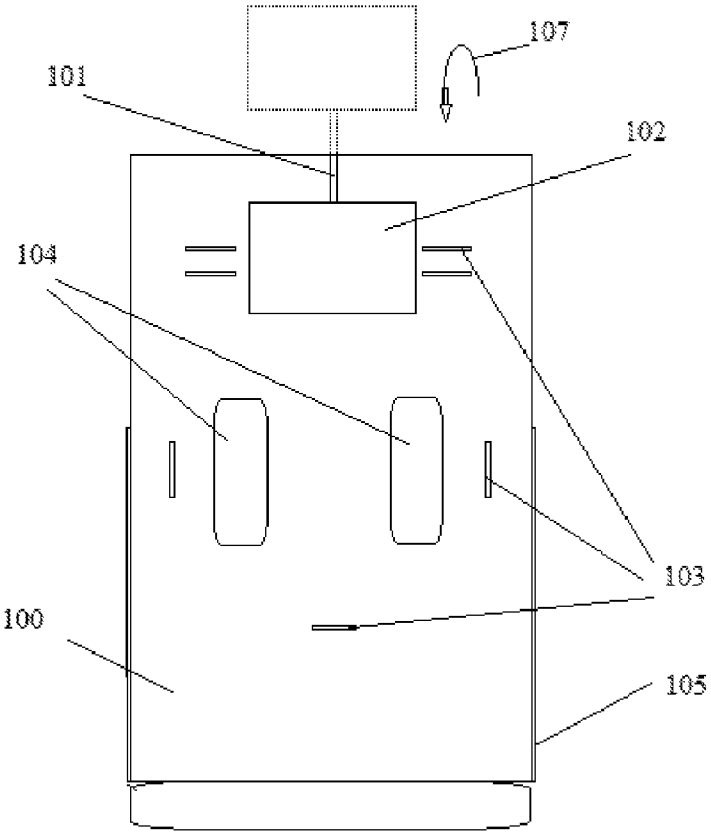
FIG. 1 is a top view of the front surface of the seat liner situated on a flat surface.

Referring now to the drawings, FIG. 1 depicts a top view of the front surface 100 of the seat liner situated on a flat surface. As depicted, the seat liner comprises a mat having a rectangular main panel. However, as a number of strollers, stroller bassinets, and high chairs of various modifications expand annually, one skilled in the art will appreciate that the main panel of the seat liner may be of various shapes, other than rectangular.

In the preferred embodiment, the main panel is approximately 13-14 inches wide and approximately 32 inches long, which will comfortably accommodate most children and strollers. The main panel is preferably made of a soft, comfortable, durable material, said material enclosing a body of memory foam insert. In order to prevent moisture damage to the memory foam insert, the main panel may preferably include a layer of water resistant material between the external cloth surface of the main panel and the body of memory foam insert. In another embodiment, such water resistant layer can be a coating applied to the surface of the body of memory foam insert or a layer connected to the inside surface of the cloth exterior of the main panel. Also, preferably, the memory foam insert may be covered with a water repellant coating to enable the user to easily wipe and clean the memory foam insert. Preferably, the water repellant coating covers the entire top surface of the memory foam.

Said memory foam insert preferably comprises a body of high density memory foam, or any other Visco Elastic material known in the art, which is most preferably 1" (one inch) thick. The memory foam insert, as recommended by Chiropractors, helps to avoid musculoskeletal stress and supports the appropriate anatomical development because such memory foam conforms to the shape of the child's body and reduces the number of pressure points on the child.

The memory foam cushion is also preferable to be used to accommodate children with disabilities to provide extra comfort and support and may also contribute in improved blood circulation for children bound to be seated in special medically prescribed strollers or chairs. One skilled in the art may appreciate that the memory foam insert may be made of any type of memory or Visco Elastic material known in the art.

In the preferred embodiment, the memory foam insert comprises a raised lower back rest section 104 which is most preferably raised up to 1" (one inch) above the main body of the memory foam insert. The raised lower back section 104 may be formed by the same piece of memory foam as the memory foam insert or may be a separate body of piece of memory foam attached to the main body of the memory foam insert. Preferably, the raised lower back section 104 swells or slopes upward from the main body of the memory foam insert to a height up to 1" (one inch) above the top surface of the main body of the memory foam insert measured at the middle of the top surface 100 of the main panel.

In another embodiment, the raised lower back section 104 swells or slopes upward from the main body of the memory foam insert to a height of 1" (one inch) or more above the top surface of the main body of the memory foam insert measured at the middle of the top surface 100 of the main panel In yet another embodiment, the main panel may comprise a combination of memory foam and at least one other material, for example, poly-fiber, cotton, Thinsulate™, or gel-type materials.

The upper portion of the main panel comprises a plurality of horizontally oriented slits 103 designed to accommodate shoulder straps to protrude through the main panel to secure child's torso within said stroller.

The mid-section of the main panel comprises a plurality of vertically oriented slits 103 designed to accommodate waist straps of a stroller to secure child's torso within said stroller.

The lower section of the main panel comprises at least one horizontally oriented slit designed to accommodate a strap attached to a lock for interconnecting shoulder straps and waist traps in the single point of contact to ensure safe positioning of a child within the stroller.

It should be understood that slits, both vertically and horizontally oriented, may be adopted to be of different size and form to accommodate ever evolving designs of strollers equipped with waist and shoulder straps of various width and configuration. Also, slits may be substituted with cut-outs or various shape and form to accommodate straps within wide variety of seating equipment for children.

It should also be noted that the slits are preferably reinforced with heavy duty peripheral stitching or the like. Also, one skilled in the art may appreciate that the slits may be equipped with Velcro fasteners, snaps, buttons, magnets, etc.

In the preferred embodiment, the seat liner also comprises raised detachable head rest 102 providing an extra head elevation for infants suffering from gastroesophageal reflux.

Said raised head rest 102 may comprise same soft, comfortable, and durable material as used for the main panel, said material enclosing a separate body of memory foam. The head rest 102 is preferably connected to the main panel via flexible strap 101, wherein said flexible strap 101 is attached to the exterior of the rear surface of the main panel.

In the preferred embodiment, said flexible strap 101 is attached to the rear surface of the main panel with Velcro fasteners, snaps, clip and the like.

FIG. 1 depicts the raised head rest 102 positioned on the upper portion of the seat liner's front surface as said flexible strap 101.

One skilled in the art will appreciate that the raised head rest 102 may be of various shapes and dimensions.

In a preferred embodiment, at least one of the side edges of the seat liner comprises at least one attachment unit 105 to secure a detachable blanket that may serve as a cover to keep the baby warm in a cold weather or that may serve as a cover with SPF for summer. The at least one attachment unit may comprise a zipper, Velcro fasteners, clips, hooks, snaps, and the like.

The detachable blanket may also be used to cover the slits or cut-outs when the seat liner is removed from the stroller and optionally used as either a play mat or a diaper changing pad. The seat liner may also be used as comfortable flat mat for newborns and/or infants who are not yet able or recommended to be seated in the upright position.

When used to cover the slits or/and the cut-outs when the seat liner is used as either play mat or a diaper changing pad, the detachable blanket is secured from at least two edges of the seat liner to avoid the sliding of the detachable blanket from the top surface 100 of the seat liner when a child is placed on the liner covered by the detachable blanket.

In one of the embodiments, at least one of the side edges of the seat liner may also comprise means to secure the liner within the frame of the stroller.

In yet another embodiment, at least one of the side edges of the seat liner may also comprise means to secure various children accessories, such as pacifiers, toys, teethes, and bottles.

In yet another embodiment, the seat liner may also comprise one or more compartments attached to at least one of the edges of the main panel. Said compartments may provide portable space to store various children accessories, such as first aid kit, diapers, wipes, pacifiers, etc. Said compartments may be made in a form of a pouch, pocket, insert and the like. The compartments may preferably be equipped with means to ensure that the contents of said compartments are secured. Such means may comprise one or more zippers, buttons, Velcro fasteners, hooks, clips, magnets and the like. In one of the embodiments, one or more compartments may be permanently attached to the main panel of the seat liner. In another embodiment, one or more compartments may be attached to the main panel via one or more zippers, buttons, Velcro fasteners, hooks, clips, magnets and the like. Such detachable compartments may be readily removed when not needed. Most preferably, the compartments are made of flexible material so it could be rolled or folded when the seat liner itself is rolled or folded.

The arrow 107 on FIG. 1 indicates the direction at which the head rest 102 is extended over the top edge from the rear surface 200 of the main panel to the front surface 100 of the main panel in order to for the head rest 102 to be positioned on the exterior of the front surface 100 of the main panel.

One skilled in the art will appreciate that the seat liner may be one-sided or it may be reversible, the two sides of the reversible seat liner may be made from the same material or it can be made from different types of materials.

FIG. 2 depicts a top view of the rear surface of the seat liner situated on a flat surface.

The upper portion of the rear surface 200 of the main panel comprises at least one attachment unit 201 to secure the flexible strap to the main panel.

When the head rest is not in use, said head rest 203 may be securely positioned on the exterior side of the rear surface of the main panel. In another embodiment, the head rest 102 may be removed from the main panel by detaching the flexible strap 101 from the harness unit 201 of the rear surface 200 of the main panel.

In further embodiment, the exterior of the rear surface 200 of the main panel may comprise one or more slide-proof or nonskid surfaces 202 to prevent the seat liner to move as a child moves while seated upon the seat liner inside the stroller. Although FIG. 2 depicts a pattern or a group of high-friction strips, one skilled in the art should note that the non-skid effect may also be achieved by employing non-skid elements such as, rubber nubs, snaps, zippers, hooks, buttons, hook fasteners, or other conventional means known in the art.

In yet another embodiment, the rear surface 200 of the seat liner also may preferably comprise an elastic bend 205 (preferably made of light, flexible, and durable fabric or other material) to secure the seat liner in the folded or rolled positions.

In yet another embodiment, the elastic bend 205 may be either supplemented or substituted with other means of securing the seat liner to a stroller. Said additional means may comprise Velcro fasteners, ties, bends, buttons and the like.

Figure 3:
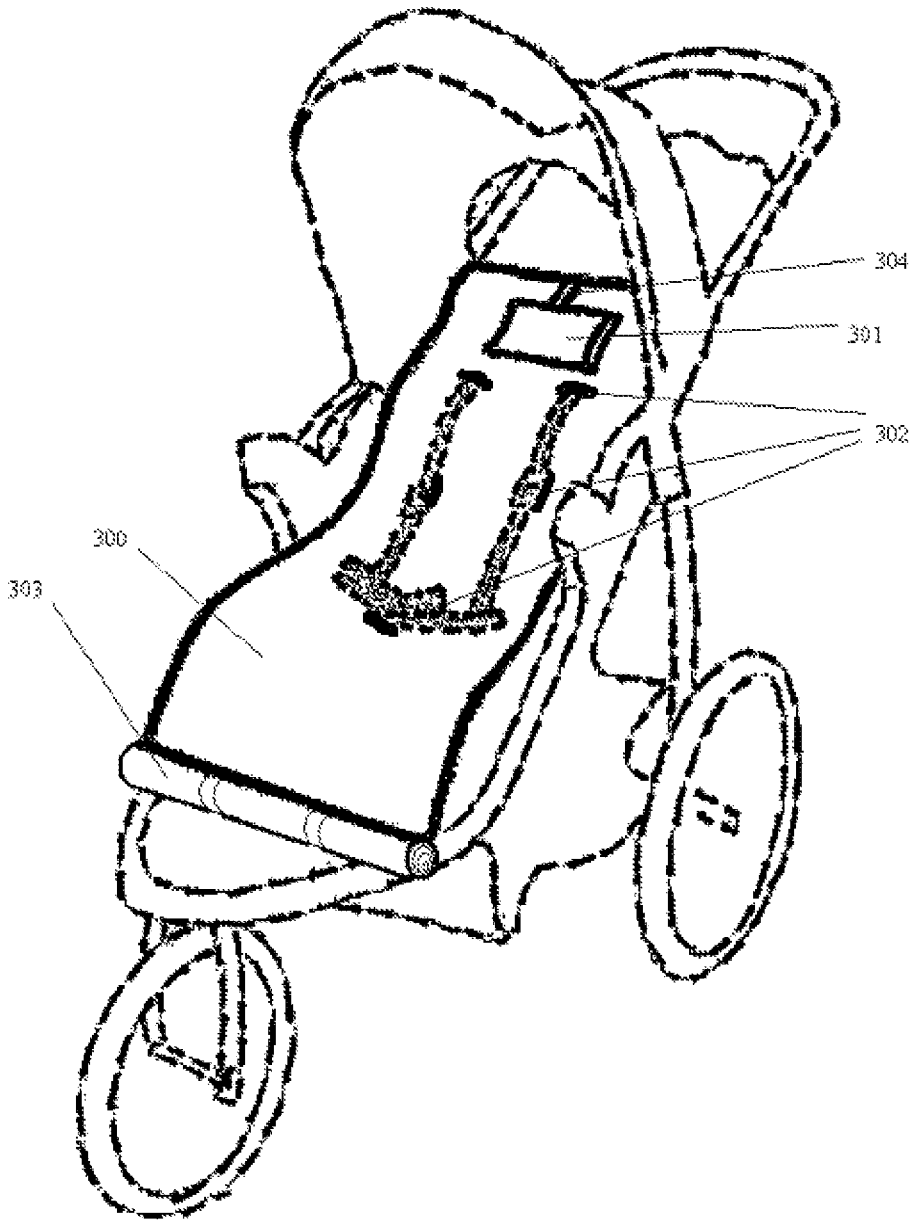
FIG. 3 is an isometric view of a seat liner situated within a stroller, wherein the seat liner comprises: i) a detachable head rest situated at the upper portion of the front surface of the seat liner; and ii) a detachable blanket attached to the bottom edge of the seat liner.

Although, FIG. 3 depicts the elastic bend 205 as positioned on the upper portion of the rear surface 200 of the main panel, one skilled in the art may understand that the elastic bend 205 may be positioned in any portion on the rear surface 200.

One skilled in the art may appreciate that the elastic bend 205 may also be used to secure the seat liner to the frame of a stroller, handle, back seat, etc. It should be noted that the elastic bend 205 may be substituted with other securing means known in the art.

The arrow 204 on FIG. 2 indicates the direction at which the head rest 102 is extended over the top edge from the front surface 100 of the main panel to the rear surface 200 of the main panel in order to for the head rest 102 to be positioned on the exterior of the rear surface 200 of the main panel.

It should be understood that the versatile seat liner described in the present application is reversible and, as such, may accommodate for convenient reattachment of non-skid elements from the rear surface of the main panel to the front surface of said main panel. The seat liner also accommodates the repositioning of the attachment unit for the elastic strap 101.

One or more attachment units may be presented in the form of one or more hooks, straps, hook & loop fasteners or other means of attachment known in the art.

FIG. 3 is an isometric view of the main panel 300 of the seat liner situated in one of its intended position within a conventional stroller for children, wherein the seat liner comprises a detachable head rest 301 situated at the upper portion of the front surface of the seat liner and attached to the seat liner with the flexible strap 304. FIG. 3 further depicts shoulder and waist straps protruding the slits 302 in order to provide child's safety inside the stroller. Also, FIG. 3 depicts a detachable blanket 303 attached to the bottom edge of the seat liner and secured in its rolled position when unused. It should be noted that the detachable blanket 303 may also be secured to any other edge of the main panel with zipper, Hook and Loop fasteners, clips and the like.

Figure 4:
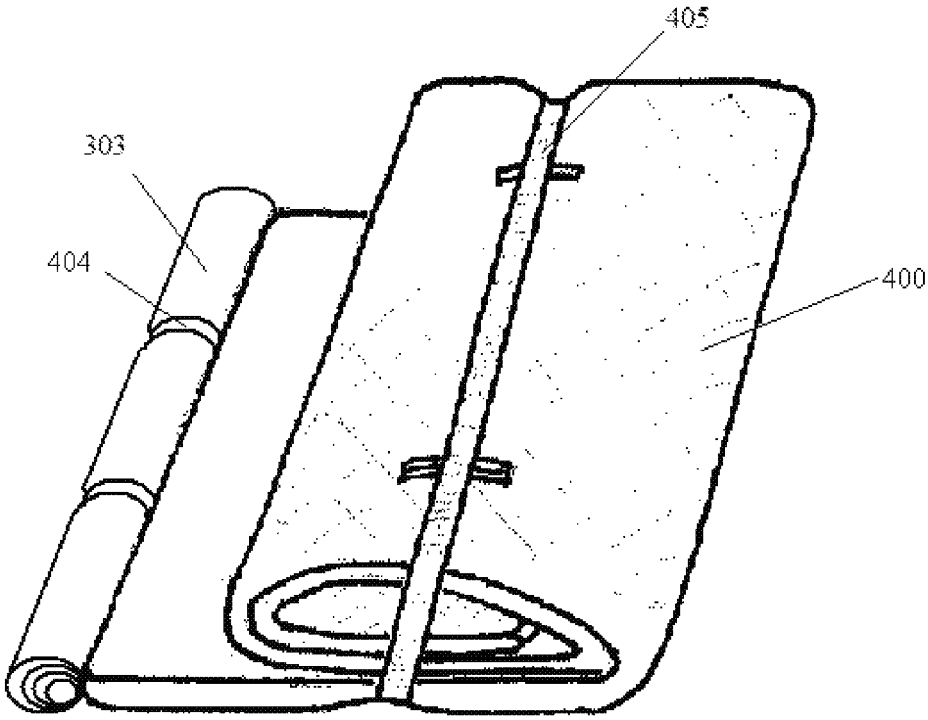
FIG. 4 is an isometric view of the seat liner is depicted in its folded position in which the seat liner is secured with an elastic bend attached to the rear surface of the seat liner; an optionally detachable blanket is attached to the least one of the edges of the seat liner.

FIG. 4 depicts the main panel 400 of the seat liner folded "three-fold" and secured by the elastic strap 405. One skilled in the art would appreciate that there may be other suitable means for securing the seat liner in the rolled position, such as snaps or other closure means such as a zipper, buttons, Velcro fasteners, or other conventional means known in the art.

Figure 5:
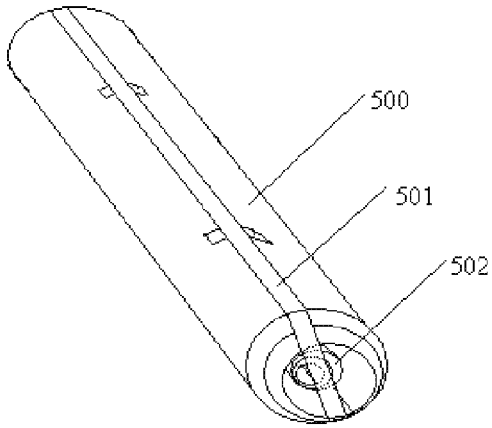
FIG. 5 is an isometric view of the seat liner is depicted in its rolled position in which the seat liner is secured with an elastic bend attached to the rear surface of the seat liner, wherein an optionally detachable blanket is attached to at least one of the edges of the seat liner and securely enclosed within the rolled up seat liner.

FIG. 5 is an isometric view of the main panel 500 of the seat liner secured in its rolled position when unused to preserve the integrity of the memory foam insert and create a compact and portable assembly. As depicted on FIG. 5, the main panel 500 is secured in its rolled up position via the elastic strap 501. Also, FIG. 5 depicts a detachable blanket 502 which is attached to at least one of the edges of the seat liner and securely enclosed within the rolled up seat liner.

It should be noted that the detachable blanket may also be secured to any other edge of the main panel 500 with one or more zippers, Velcro fasteners, clips and the like. Just as in the folded position, the rolled up seat liner ensures a high degree of portability for travel purposes because the seat liner may be easily carried to and used during various children's activities that do not require a stroller. Also, easily removable seat liner may be cleaned regularly.

It will now be appreciated that the present invention relates to a cover designed for use on a seat of a collapsible stroller, stroller bassinet, car seat, high chair, and the like. The structure of the cover includes portions which encircle the frame. For strollers of the type having an adjustable seat, the cover is designed to accommodate the forwardly extending side of the seat and secure the cover to the frame, without obscuring the linkage provided to adjust the position of the seat or interfering with the operation thereof.

The above description has focused on a representative sample of all possible embodiments, a sample that teaches the principles of the invention and conveys the best mode contemplated for carrying it out. Throughout this application and its associated file history, when the term "invention" is used, it refers to the entire collection of ideas and principles described; in contrast, the formal definition of the exclusive protected property right is set forth in the claims, which exclusively control. The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. In many cases, one feature or group of features may be used separately from the entire apparatus or methods described. Many of those undescribed variations, modifications and variations are within the literal scope of the following claims, and others are equivalent.

While only a single preferred embodiment of the present invention has been disclosed herein for purposes of illustration and, as such, has been described in some detail for purposes of clarity and understanding, it will be appreciated by one skilled in the art, from a reading of the disclosure, that various changes in form and detail can be made without departing from the true scope of the invention. It will also be appreciated that it is obvious that many variations and modifications could be made thereto. It is intended to cover all of these variations and modifications, which fall within the scope of the present invention as defined by the following claims:

What is claimed is:

1. A seat liner comprising:

a generally rectangular panel comprising a front surface, a rear surface, said front and rear surfaces each comprising an upper section, a middle section and a bottom section, a plurality of outer edges that form a perimeter of the rectangular panel connecting the front surface and the rear surface, a memory foam insert enclosed within the said panel;

wherein the upper section of the panel comprising:

a plurality of horizontally oriented slits protruding through the main panel; and a detachable head rest, wherein said detachable head rest is attached to the panel via a flexible strap, wherein said flexible strap is attached to the exterior of the rear surface of the panel and extended over the top of the outer edge of the panel so the detachable head rest is situated on the front surface of the upper section of the panel; wherein the middle section of the panel comprising:

a plurality of vertically oriented slits protruding through the main panel; and a raised lower back rest section, said raised lower back rest section is situated on the front surface of the panel and raised up to 1" above the surface of the memory foam insert;

wherein the bottom section comprising:

at least one horizontally oriented slit;

a detachable blanket attached to the bottom outer edge of the panel; and a plurality of fasteners for maintaining the blanket in a rolled position at the bottom outer edge of the panel when the blanket is not in use, while the panel is in an unrolled condition;

wherein the rear surface of the panel comprising:

at least one attachment unit designed to connect the detachable head rest to the main panel;

at least one securing bend having a first end and a second end, the first end attached to a first side of the upper surface of the rear surface of the panel and the second end attached to a second side of the upper surface of the rear surface of the panel, therewith forming a continuous loop on the rear surface of the panel that extends laterally across the rear surface of the panel, said bend adapted to maintain the panel in the rolled condition;

and one or more non-skid surfaces attached to the rear surface of the panel;

wherein at least one other outer edge comprising one or more attachment units to secure the detachable blanket when said blanket is extended from the rolled position in the direction toward the upper section of the panel.

2. The seat liner of claim 1, wherein the panel comprising one or more layers of water resistant material between the external cloth surface of the panel and the body of memory foam insert.

3. The seat liner of claim 1, wherein the panel is in a form that is other than rectangular.

4. The seat liner of claim 1, wherein at least one of the outer edges of the panel comprising two or more attachment units to secure the panel to a frame of at least one of: a stroller, a stroller bassinet, a car seat, and a high chair.

5. The seat liner of claim 1, wherein, at least one of the outer edges of the panel comprising one or more attachment units to secure at least one of: as pacifier, a toy, a drinking device, and a bottle.

6. The seat liner of claim 1, wherein the raised lower back section is formed by the same piece of memory foam as the memory foam insert.

7. The seat liner of claim 6, wherein the raised lower back section is formed by a separate body of piece of memory foam attached to the main body of the memory foam insert.

8. The seat liner of claim 1, wherein the panel comprising a combination of the memory foam and at least one other material.

9. The seat liner of claim 1, wherein the front surface and the rear surface of the panel comprising a personalized insignia.

10. The seat liner of claim 1, wherein the seat liner is reversible, wherein the front surface of the panel is adapted to serve as the rear surface and wherein the rear surface of the panel is adapted to serve as the front surface of the panel.

11. The seat liner of claim 1, wherein the raised lower back rest section is situated on the front surface of the panel and raised more than 1" above the surface of the memory foam insert.

* * * * *